United States Patent [19]

Kamimura et al.

[11] Patent Number: 5,040,028

[45] Date of Patent: Aug. 13, 1991

[54] IMAGE FORMING APPARATUS WITH A TONER TRANSFER DEVICE

[75] Inventors: Taisuke Kamimura, Nara; Yasuhiro Takai, Sakurai; Yoichi Shimazawa, Nara; Etsuji Nukushina, Nara; Hideo Matsuda, Nara, all of Japan

[73] Assignee: Sharp Kabushiki Kaisha, Osaka, Japan

[21] Appl. No.: 478,823

[22] Filed: Feb. 12, 1990

[30] Foreign Application Priority Data

Feb. 14, 1989 [JP] Japan ..... 1-34511

[51] Int. Cl.[5] ..... G03G 15/16

[52] U.S. Cl. ..... 355/275

[58] Field of Search ..... 355/271, 274, 275, 326, 355/327; 430/126

[56] References Cited

U.S. PATENT DOCUMENTS 4,341,455 7/1982 Fedder ..... 355/274

4,652,115 3/1987 Palm et al. ..... 355/275 X

FOREIGN PATENT DOCUMENTS 63-311263 12/1988 Japan ..... 430/126

1-288877 11/1989 Japan ..... 355/274

*Primary Examiner*—Joan H. Pendegrass

*Attorney, Agent, or Firm*—Birch, Stewart, Kolasch & Birch

[57] ABSTRACT

A toner transfer device which transfers toner on a photoconductor to an intermediate transfer belt applied on a plurality of rollers, wherein at least part of the surface of the photoconductor moves in an arc while being pressed against the intermediate transfer belt, the toner transfer device comprising: a pair of transfer rollers disposed along the intermediate transfer belt between two of the rollers in such a manner that the part of the surface of the photoconductor which moves in an arc is positioned between the transfer rollers, at least part of each transfer roller being located outside each of two tangents, one of the tangents touching the photoconductor and one of the two rollers, the other tangent touching the photoconductor and the other roller, thereby allowing a certain length of the intermediate transfer belt between the two transfer rollers to be pressed against the part of the surface of the photoconductor moving in an arc; and a means for applying voltage to the transfer rollers, the voltage polarity being opposite to that of the toner.

7 Claims, 8 Drawing Sheets

IMAGE FORMING APPARATUS WITH A TONER TRANSFER DEVICE

BACKGROUND OF THE INVENTION

1. Field of the invention

The present invention relates to an improved intermediate transfer device which transfers toner on a photoconductor first to an intermediate transfer belt and then onto a paper, and to an improved toner transfer device (hereinafter called the "1st toner transfer device) which transfers the toner on the photoconductor to the intermediate transfer belt in the intermediate transfer device.

2. Description of the prior art

In recent image forming apparatuses for full color image forming, toner images of yellow, magenta, and cyan are separately formed on a photoconductor, and the thus formed toner images are transferred onto an intermediate transfer belt in such a way that one toner image is superimposed on top of the other, the transferred image being further transferred onto copy paper. Once the colored toner images are superimposed one on top of the other on the intermediate transfer belt, the transfer to the copy paper can be accomplished in a single operation, so this method can prevent copy paper from being damaged.

In the conventional 1st transfer device, toner transfer from the photoconductor to the intermediate transfer belt has been accomplished using a transfer charger which generates corona. However, the transfer charger that utilizes corona discharge for transfer of toner has had the following difficulties in terms of toner transfer.

(1) Transfer area is limited, and uneven transfer may be caused because of unevenness in the potential on the reverse surface of the intermediate transfer belt. (Refer to FIG. 9)

(2) When a low-resistivity ($10^8\Omega$ cm or lower) intermediate transfer belt is used, the transfer belt becomes charged because of the corona, and good quality transfer cannot be obtained for the 2nd transfer (transfer of the toner on the intermediate transfer belt to the copy paper). Therefore, in the conventional 1st transfer device, it has been necessary to restrict the resistivity of the intermediate transfer belt, or to provide a device which removes the charge from the intermediate transfer device prior to the 2nd transfer.

(3) Insufficient pressure between the photoconductor and the intermediate transfer belt has resulted in uneven superposing of the three color image layers, missing portions of the three color image layers, and other defects, that affect the copy quality.

SUMMARY OF THE INVENTION

The toner transfer device of this invention, which overcomes the above-discussed and numerous other disadvantages and deficiencies of the prior art, is a toner transfer device which transfers toner on a photo-conductor to an intermediate transfer belt applied on a plurality of rollers, wherein at least part of the surface of said photoconductor moves in an arc while being pressed against said intermediate transfer belt, said toner transfer device comprising: a pair of transfer rollers disposed along said intermediate transfer belt between two of said rollers in such a manner that said part of the surface of said photoconductor which moves in an arc is positioned between said transfer rollers, at least part of each transfer roller being located outside each of two tangents, one of said tangents touching said photoconductor and one of said two rollers, the other tangent touching said photoconductor and the other roller, thereby allowing a certain length of said intermediate transfer belt between said two transfer rollers to be pressed against said part of the surface of said photoconductor moving in an arc; and a means for applying voltage to said transfer rollers, the voltage polarity being opposite to that of the toner.

In a preferred embodiment, each of said transfer rollers is so located that said intermediate transfer belt is not caught between the transfer roller and said photoconductor.

In a preferred embodiment, each of said transfer rollers is so located as to position said intermediate transfer belt approximately 0.5 to 1.5 mm outwardly from each of said tangent.

In a preferred embodiment, each of said transfer rollers is located approximately 10 to 15 mm away from the point at which each of said tangents touches said photoconductor.

In a preferred embodiment, the two transfer rollers function as idlers that are driven by the rotation of said intermediate transfer belt.

In a preferred embodiment, the voltage applied to said transfer rollers is within the range of 400 to 1000V of the opposite polarity to that of the toner.

The intermediate transfer device of this invention is an intermediate transfer device which transfers toner on a photoconductor to an intermediate transfer belt before said toner is transferred onto paper, wherein the intermediate transfer belt being formed of a dielectric having a resistivity of approximately $10^7$ to $10^{11}\Omega$ cm.

Thus, the invention described herein makes possible the objectives of (1) providing a first toner transfer device which is capable of accomplishing transfer of sufficiently good quality without restricting the resistivity of an intermediate transfer belt and (2) providing an intermediate transfer device having an intermediate transfer belt capable of producing copy image of excellent quality.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 7:
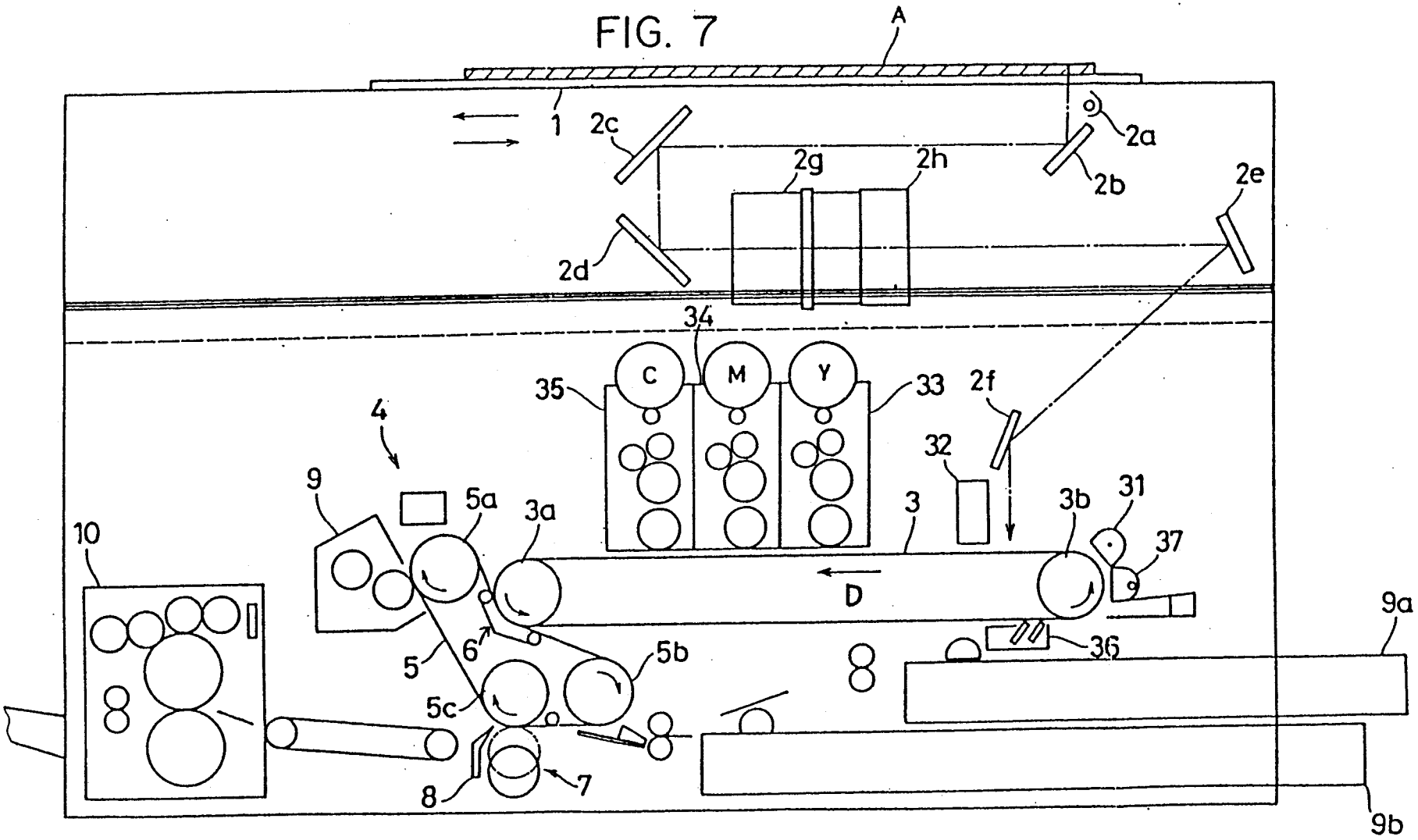
FIG. 7 is a sectional front elevation showing a copying apparatus having the intermediate transfer device with the first toner transfer device of this invention.

FIG. 7 is a schematic diagram showing the front view of a full-color copying machine having the intermediate transfer device with the first toner transfer device.

A document table 1 formed of transparent glass is provided on the top surface of the copying machine. On the document table 1, a document A to be copied is placed with its document side facing down. Disposed under the document table 1 is an optical device including a light source 2*a*, mirrors 2*b* to 2*f*, a lens 2*g*, and a filter 2*h*. The optical device scans the document A on the document table 1, and directs the reflected light onto a belt-like photoconductor belt 3. The filter 2*h* is used to separate the light reflected from the document into three primary colors, red, green, and blue, and to selectively transmit any one of these colors.

The photoconductor belt 3 is provided with a photoconductive layer, the resistivity of which decreases when illuminated with light. The photoconductor belt 3 is stretched with a driving roller 3*a* on one end and an idler roller 3*b* at the other end. The driving force is transmitted from a motor not shown to the driving roller 3*a* for rotation in the direction shown by arrow D in FIG. 7. In the vicinity of the idler roller 3*b* are disposed a cleaning device 36, a discharge lamp 37 and a charge corona 31 in the order of the direction of rotation of the photoconductor belt 3. A blank lamp 32 and developer units 33 to 35 are disposed above the photoconductor belt 3 and an intermediate transfer device 4 is disposed in the vicinity of the driving roller 3*a*. Yellow toner is contained in the developer unit 33, magenta toner in the developer unit 34, and cyan toner in the developer unit 35.

In the above construction, toner images are formed on the photoconductor belt 3 in approximately the same manner as in a conventional electrophotographic image forming apparatus. The light reflected from the document is projected onto the photoconductor belt 3 charged by the charge corona 31 to form an electrostatic latent image thereon, and the latent image on the photoconductor belt 3 is developed by the developer units 33 to 35. The toner images formed on the photoconductor belt 3 are transferred first to the intermediate transfer device 4 and then to copy paper. For image forming operations by the developer units 33 to 35, the developer unit which contains the toner of the complementary color, of the color of the light reflected from the document and transmitted through the filter 2*h* is put into operation. For example, when blue light is transmitted, the developer unit 33 containing yellow toner is put into operation to form a yellow toner image.

The intermediate transfer device 4 comprises an intermediate transfer belt 5 applied on a driving roller 5*a*, an idler roller 5*b*, and a backup roller 5*c*, a 1st toner transfer device 6, a 2nd toner transfer device 7, a separator plate 8, and a cleaning device 9.

The toner images formed on the photoconductor belt 3 are transferred by means of the 1st toner transfer device 6 onto the intermediate transfer belt 5, and the thus transferred images are further transferred to the copy paper which is fed from a paper cassette 9*a* or 9*b* installed in the upstream side of the copy paper transporting direction of the copying machine. The yellow, magenta, and cyan images formed on the photoconductor belt 3 are transferred to the intermediate transfer belt 5, one being superimposed one on the other, and then, the thus formed full color image is transferred onto the copy paper. The full color image transferred onto the copy paper is fixed to the copy paper in a fixing device 10 before being discharged out of the copying machine.

Figure 1:
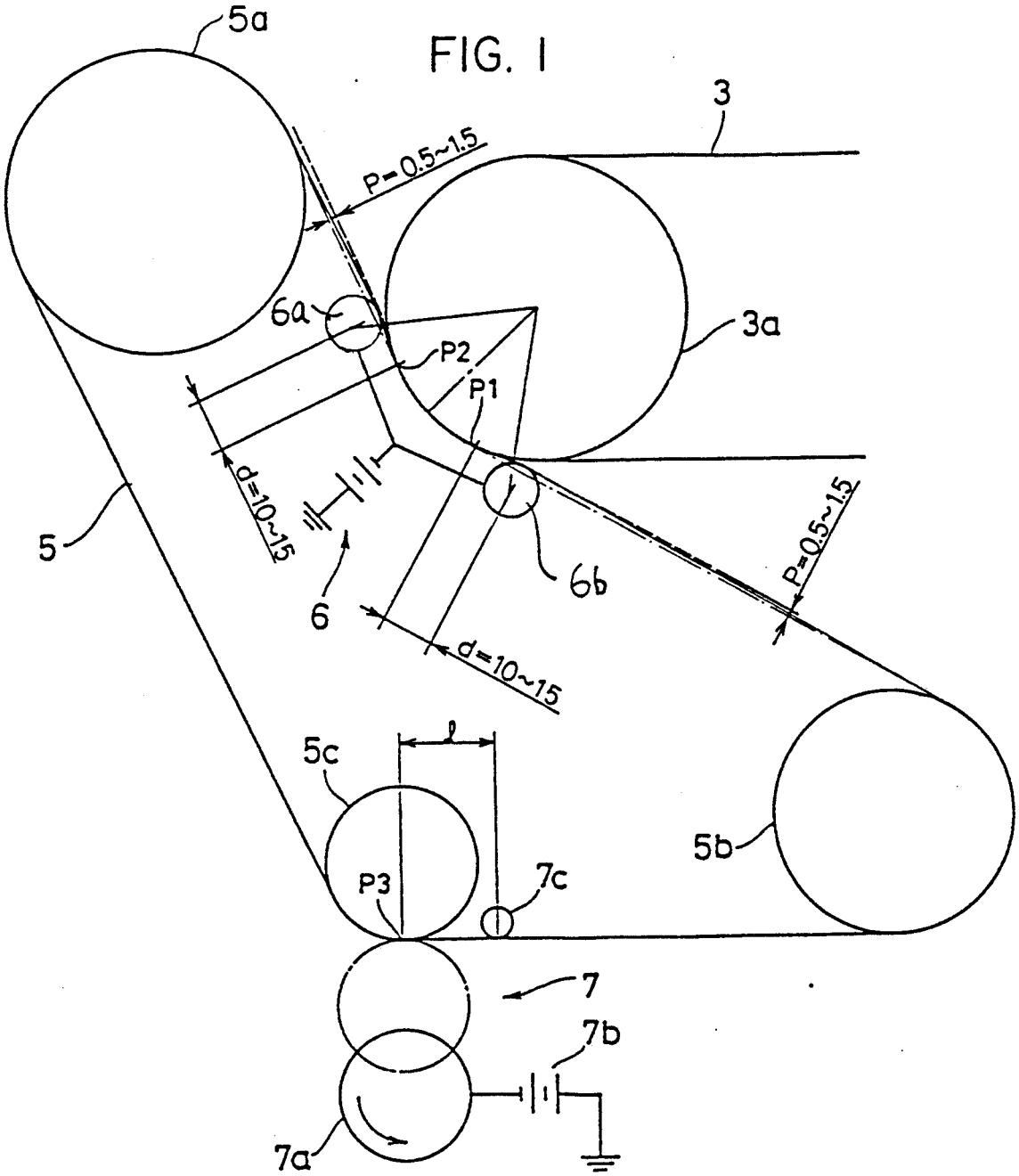
FIG. 1 is a diagram showing the construction of an intermediate transfer device of this invention.

The following detailed description deals with the construction of the intermediate transfer device 4. FIG. 1 is a diagram showing the construction of the intermediate transfer device.

The intermediate transfer belt 5 is formed from a sheet-like dielectric material such as polycarbonate the resistivity of which is adjusted with carbon black dispersed therein. According to the experiments conducted by the inventors, it is desirable that the resistivity of the intermediate transfer belt 5 be within the range of $10^7$ to $10^{11}\Omega$ cm. If the resistivity is set at a higher level, the toner adhesion will become too strong, resulting in transfer failure for the second transfer (toner transfer from the intermediate transfer belt 5 to the copy paper). To prevent the transfer failure, a device will have to be provided to remove the charge after the 1st transfer (toner transfer from the photoconductor belt 3 to the intermediate transfer belt 5). Conversely, if the resistivity is set at a lower level, sufficient electric field cannot be created necessary for the 2nd transfer, also resulting in transfer failure. To prevent this, transfer power of a large capacity will have to be provided. In a conventional transfer corona unit, when the resistivity of the intermediate transfer belt is about $10^7\Omega$ cm, the toner cannot be separated from the intermediate transfer belt at the time of the 2nd transfer. On the other hand, in the unit using the transfer rollers hereinafter described, if the resistivity is lower than that, sufficient toner separation can be achieved at the time of the 2nd transfer. However, as previously stated, the resistivity should be set preferably within the range of $10^7$ to $10^{11}\Omega$ cm.

Figure 2:
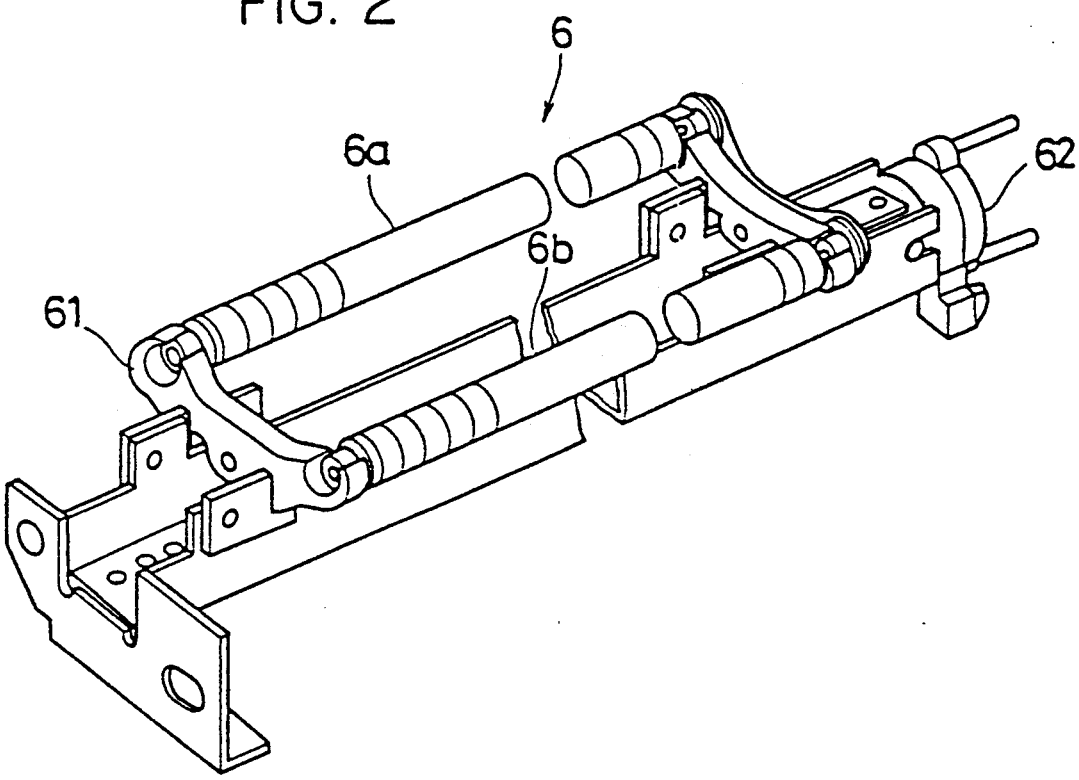
FIG. 2 is a perspective view of a 1st toner transfer device of this invention.

The intermediate transfer belt 5 is applied on the driving roller 5*a*, the idler roller 5*b*, and the backup roller 5*c*, as previously mentioned. The driving roller 5*a* is a roller of 50 mm in diameter having a surface layer, formed for example of conductive rubber, and is coupled to and driven by a main motor (not shown). The idler roller 5*b* is a roller of approximately 42 mm in diameter, formed for example of aluminum, while the backup roller 5*c* is a roller of approximately 25 mm in diameter having a surface layer of insulating rubber. The idler roller 5*b* is urged in the direction to stretch the intermediate transfer belt by means of a urging mechanism (not shown). Against the intermediate transfer belt 5 thus applied on the rollers, the photoconductor belt 3 is pressed at the portion between the driving roller 5*a* and the idler roller 5*b*. Actually, the driving roller 3*a* on which the photoconductor belt 3 is applied is pressed against the intermediate transfer belt 5, so that tension is applied to the intermediate transfer belt 5 by the driving roller 5*a*, the idler roller 5*b*, the backup roller 5*c*, and the driving roller 3*a* of the photoconductor belt 3. The 1st toner transfer device 6 is disposed where the intermediate transfer belt 5 is pressed against the photoconductor belt 3. FIG. 2 is an external view of the 1st toner transfer device.

The 1st toner transfer device is formed of metal such as stainless steel, and comprises two 1st transfer rollers 6a and 6b having a diameter, for example, of approximately 8 mm. The 1st transfer rollers 6a and 6b are supported on a supporting member 61 in a freely rotatable manner, and press contact the inner surface of the intermediate transfer belt 5. Therefore, the 1st transfer rollers 6a and 6b are easily rotatable with the rotation of the intermediate transfer belt 5. The numeral 62 indicates a connector for applying voltage to the 1st transfer rollers 6a and 6b. The connector 62 applies to the 1st transfer rollers 6a and 6b a charge of opposite polarity (+in this case) to that of the toner. The position where the 1st transfer rollers 6a and 6b are pressed against the intermediate transfer belt is set in the following manner.

A tangent which touches both the rollers 3a and 5a is in contact with the driving roller 3a at a point P2. Similarly, a tangent which touches both the rollers 3a and 5b is in contact with the driving roller 3a at a point P1. The 1st transfer rollers 6a and 6b are positioned approximately 10 to 15 mm (distance d) away from the points P1 and P2 toward the rollers 5a and 5b, respectively, and are also located in such a manner that they position the intermediate transfer belt 5 away from the above-mentioned tangents toward the driving roller 3a (i.e., outwardly from the tangents) by approximately 0.5 to 1.5 mm (distance p). Thus, the intermediate transfer belt 5 is not caught between the driving roller 3a of the photoconductor belt 3 and the 1st transfer roller 6a or between the driving roller 3a and the 1st transfer roller 6b, while the 1st transfer rollers 6a and 6b lightly press the intermediate transfer belt 5 toward the photoconductor belt 3, thereby assuring smooth 1st transfer.

Figure 4A:
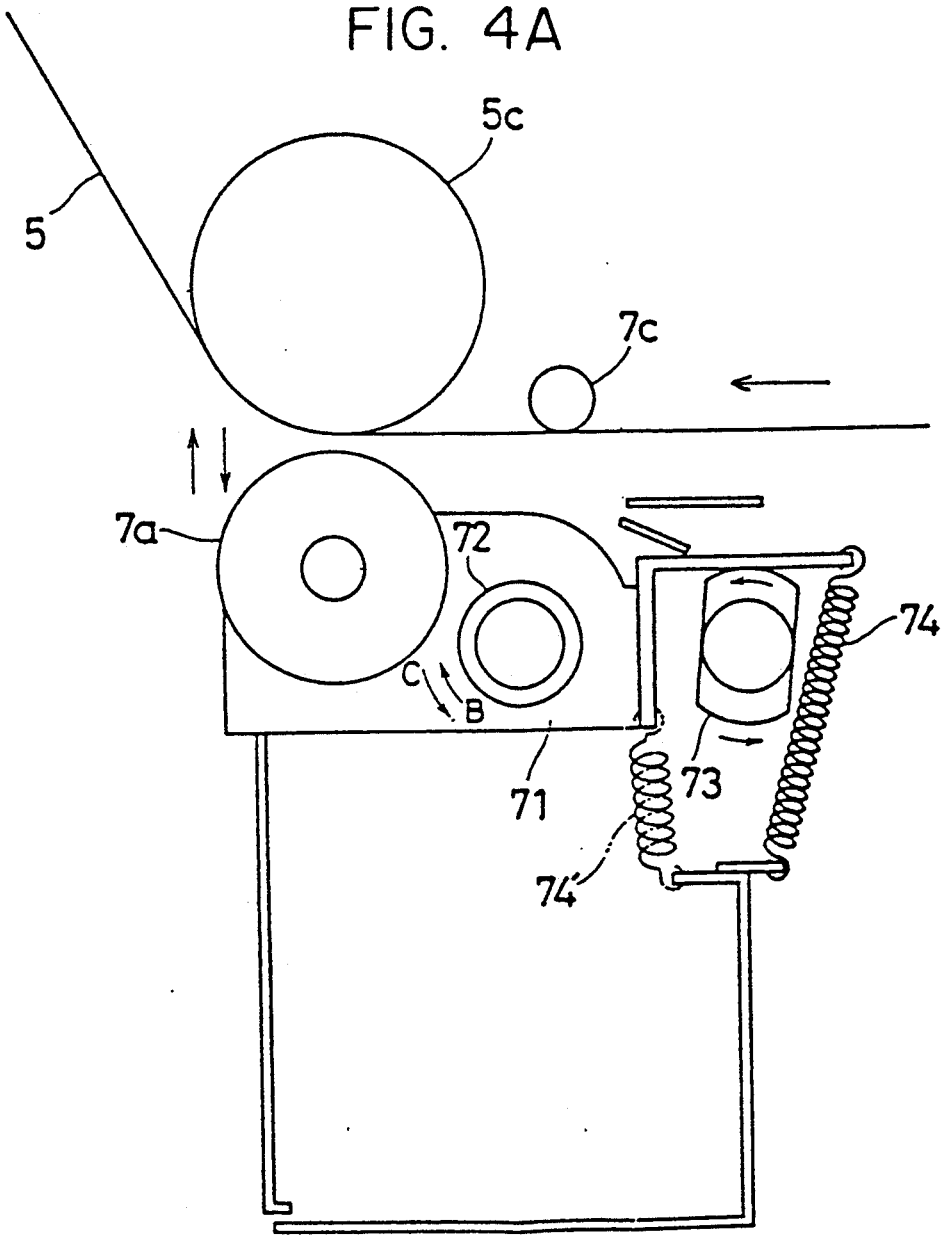
FIG. 4A is a front view of a supporting section of a 2nd transfer roller.
Figure 4B:
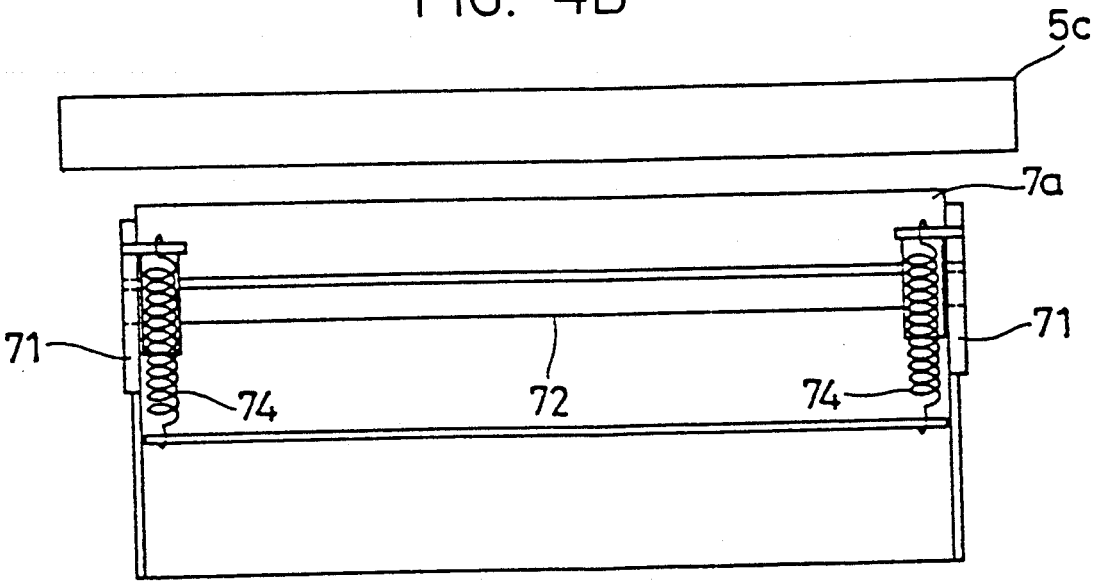
FIG. 4B is a side view thereof.

The 2nd toner transfer device 7 comprises a 2nd transfer roller 7a. The 2nd transfer roller 7a is supported in a vertically movable manner by means of a moving mechanism such as shown in FIGS. 4A and 4B. When the 2nd transfer roller 7a is moved upward, the 2nd transfer roller 7a is pressed against the backup roller 5c with the intermediate transfer belt 5 interposed therebetween. The 2nd transfer roller 7a is moved upward when copy paper is fed between the intermediate transfer belt 5 and the 2nd transfer roller 7a. The copy paper is pressed between the intermediate transfer belt 5 and the 2nd transfer roller 7a to transfer toner onto the copy paper. The following describes in detail the moving mechanism of the 2nd transfer roller with reference to FIGS. 4A and 4B. FIG. 4A is a front view of a supporting section of the 2nd transfer roller, and FIG. 4B a right side view thereof. The 2nd transfer roller 7a is rotatably supported in support plates 71 and 71 provided at axial ends thereof. Provided at the upstream side of the copy paper transporting direction of the 2nd transfer roller 7a is a shaft 72 about which each support plate 71 rotates in the direction shown by arrows B and C in FIG. 4A. A cam 73 is provided at the upstream side of the copy paper transporting direction of the shaft 72, and further at the same side thereof, a pair of springs 74, each of which is engaged with each one of two support plates 71, is provided. Each support plate 71 is made to swing in the direction shown by arrow B or C when the cam rotates. When each support plate 71 is made to swing in the direction shown by arrow B, the 2nd transfer roller 7a is pressed against the backup roller 5c. Each support plate 71 is urged upward (in the direction shown by arrow B) by means of each spring 74 to press the 2nd transfer roller 7a against the backup roller 5c. Each spring 74 is engaged with each support plate 71 at the furthest position from the shaft 72. Therefore, upward urging force is obtained in the most effective manner, and it is possible to provide sufficient urging force at each of the axial ends of the 2nd transfer roller 7a.

In FIG. 4A, the numeral 74' indicates the spring position previously employed. In contrast with this position, by thus disposing the springs 74 at the furthest position from the shaft 72, the maximum urging force can be provided at the support plates 71, respectively. For example, when the spring was installed at the position 74', difference on the pressure of the 2nd transfer roller 7a against the backup roller 5c was noted between the axial ends of the 2nd transfer roller 7a even when the lateral positional deviation of the 2nd transfer roller 7a was 0.4 mm. On the other hand, when the spring is installed at the position 74, it has been found that even when the lateral positional deviation of the 2nd transfer roller 7a is 0.8 mm, the positional deviation is absorbed and almost uniform pressure is provided at each axial end of the 2nd transfer roller 7a.

A back plate roller 7c is disposed on the inner surface of the intermediate transfer belt and in the vicinity of the backup roller 5c. The back plate roller 7c is formed of metal such as stainless steel. The back plate roller 7c is grounded, and serves as a counter electrode for the 2nd transfer roller 7a. The back plate roller 7c is disposed at a distance l=10 to 18 mm away from a point P3 shown in FIG. 1 where the 2nd transfer roller 7a is pressed against the backup roller 5c toward the idler roller 5b (upstream in the rotating direction of the intermediate transfer belt 5). The back plate roller 7c is so disposed as to lightly contact the inner surface of the intermediate transfer belt 5 in a rotatable manner. When toner is transferred from the intermediate transfer belt 5 to the copy paper, an electric field is created between the 2nd transfer roller 7a and the back plate roller 7c to cause the toner of the polarity opposite to that of the applied voltage to be attracted toward the 2nd transfer roller 7a and transferred onto the copy paper. At this time, the back plate roller 7c is rotated by the rotation of the intermediate transfer belt 5. Therefore, there is no possibility that the inner surface of the intermediate transfer belt 5 is chafed against the backup roller 5c or that dust chafed off the intermediate transfer belt 5 is fused onto the back plate roller to create problems such as transfer failure.

Figure 3:
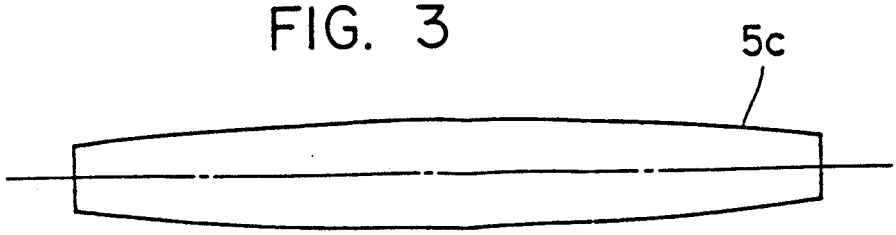
FIG. 3 is a plan view of a backup roller.
Figure 5:
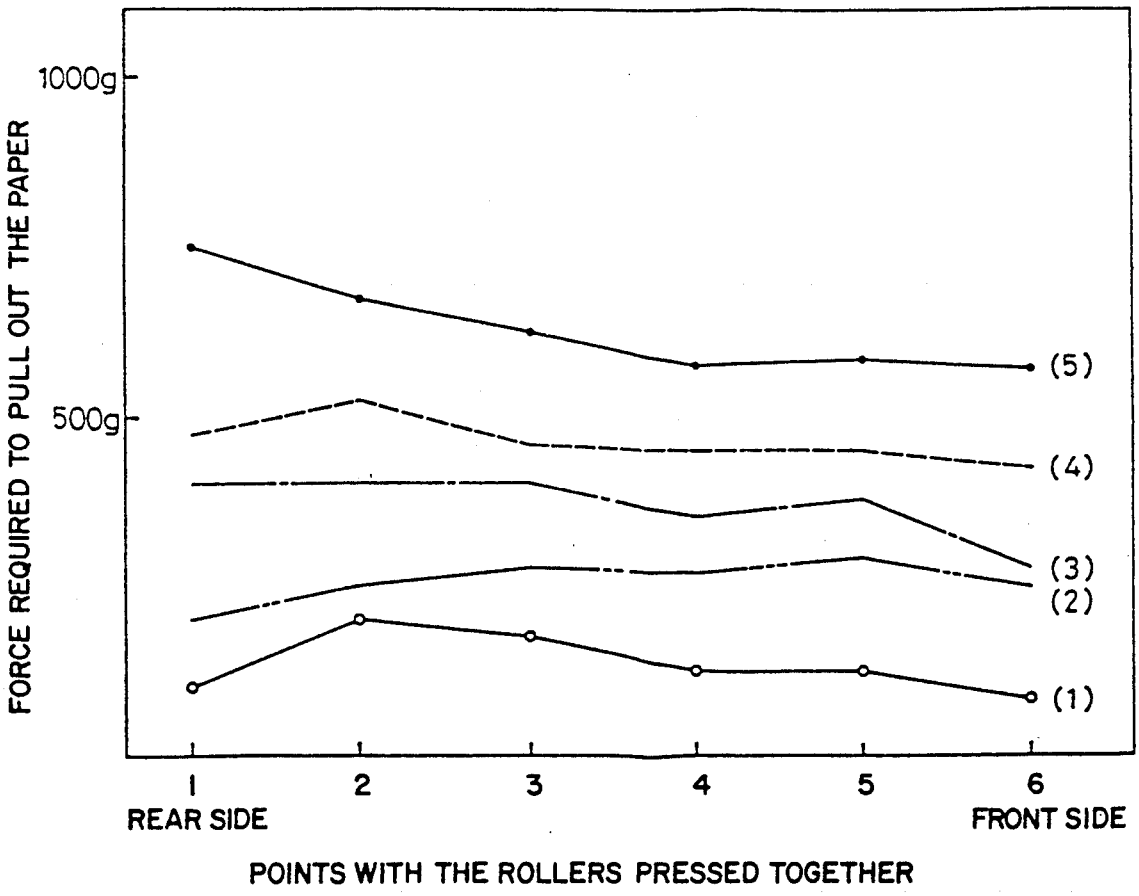
FIG. 5 is a graph showing the pressure distribution in the axial direction when pressure is applied between the backup roller and the 2nd transfer roller in the device of this invention.
Figure 6:
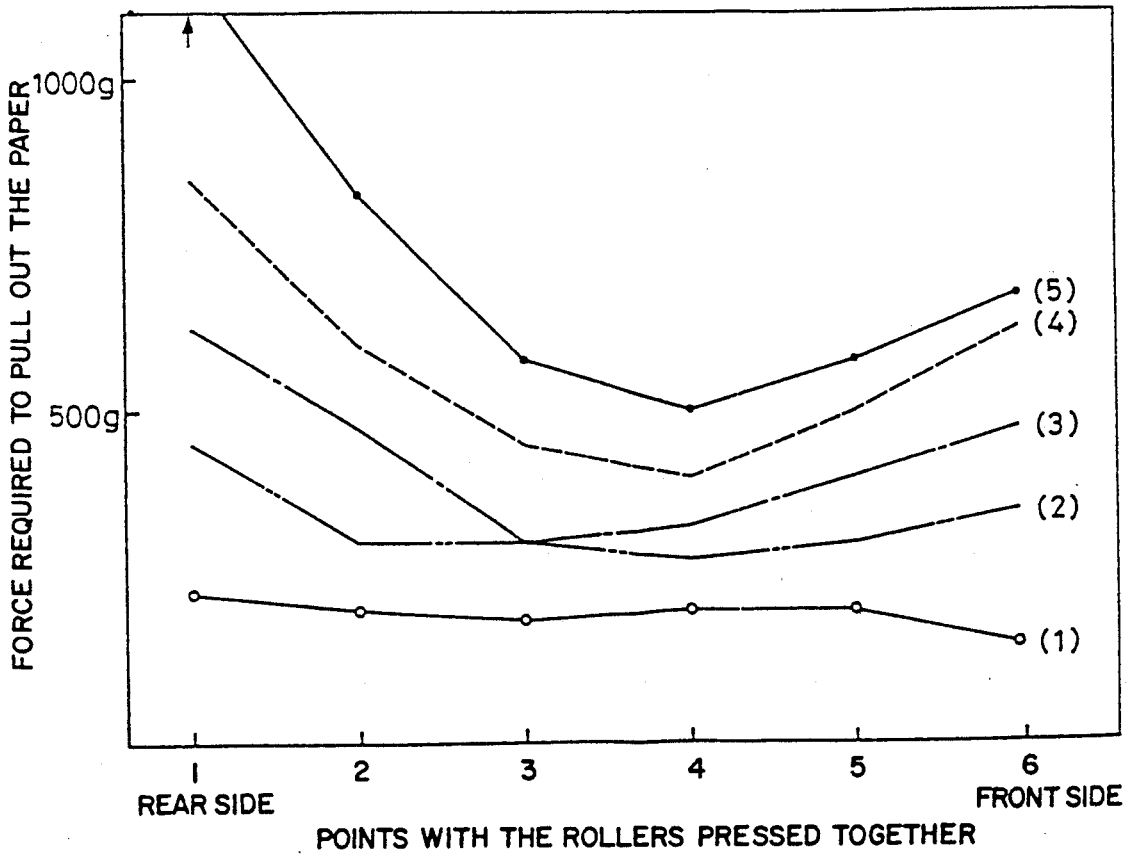
FIG. 6 is a graph showing the pressure distribution in the axial direction when pressure is applied between the backup roller and the 2nd transfer roller in a conventional device.

The core of the backup roller 5c is made of relatively hard material such as steel to prevent distortion under pressure, and the surface layer is formed from insulating material having a resistivity of, for example, of $10^{12}$ to $10^{14}\Omega$ cm. Specifically, silicon rubber, etc. is used as the insulating material. As shown in FIG. 3, the backup roller 5c has a crown-like shape in which the diameter at the axial ends is larger than the diameter at the center. The shape of the backup roller 5c is not limited to that shown in FIG. 3, but can be determined according to how the pressure is applied between the backup roller 5c and the 2nd transfer roller 7a. By forming the backup roller 5c in such a crown-like shape, uniform pressure can be obtained between the axial ends of the 2nd transfer roller 7a when the 2nd transfer roller 7a is pressed against the backup roller 5c. FIGS. 5 and 6 show pressure distributions in the axial direction when pressure is applied between the backup roller 5c and the 2nd transfer roller 7a. FIG. 5 shows the distributions when the 2nd transfer roller of this embodiment is used, while FIG. 6 shows the distributions when a conventional 2nd transfer roller is used. The 2nd transfer roller of FIG. 5 has an aluminum core, and the insulating rubber portion is formed flat in the axial direction. In this experiment, points (1) to (6) were set at 5 cm intervals in the axial direction along the pressed portion between the backup roller 5*c* and the 2nd transfer roller 7*a* each 25 cm long in the axial direction, slips of paper were placed at these points with the rollers pressed together, and the force required to pull out the paper was examined. Each slip of paper used had a thickness of 40 μm, a width of 10 mm, and a length of 50 mm. The force applied to press the rollers together was changed in five steps from (1) to (5). As shown in FIG. 6, in the conventional device, unevenness was noted in the pressure distribution in the axial direction, the pressure at the center decreasing, as the load applied between the rollers were increased. On the other hand, in the device of this embodiment, approximately uniform pressure was provided in the axial direction as shown in FIG. 5. Therefore, no uneven transfer is caused in the axial direction in image forming, and copy image of good quality can be assured.

The intermediate transfer device 4 is constructed as described above. The separator plate 8 is provided to separate copy paper from the intermediate transfer belt 5, and the cleaning device 9 is used to remove the remaining toner on the intermediate transfer belt 5.

An experiment was conducted to form a full color image using the copying machine of the above construction. The intermediate transfer belt 5 had a resistivity of $10^8$ to $10^9\Omega$ cm, and the voltage applied during the 1st transfer to the 1st transfer rollers 6*a* and 6*b* was set at 600V for yellow toner, 600V for magenta toner, and 1000V for cyan toner. Different transfer voltages were used because the charge characteristic of toner varies according to the pigments contained in the toner. Generally, the 1st toner transfer can be accomplished with satisfactory results at the applied voltage of 400 to 1000V. If the 1st transfer voltage is too high, the toner layers formed on the intermediate transfer belt 5 take on a high potential, which causes toner particles to repel each other when toner images are superimposed on the intermediate transfer belt, thus resulting in a defective image. The 2nd transfer was performed with good results at the 2nd transfer voltage of approximately 1.6V.

The intermediate transfer device of this invention is an intermediate transfer device which transfers toner on a photoconductor to an intermediate transfer belt before said toner is transferred onto paper, wherein said intermediate transfer belt being formed of a dielectric having a resistivity of approximately $10^7$ to $10^{11}\Omega$ cm.

Figure 8:
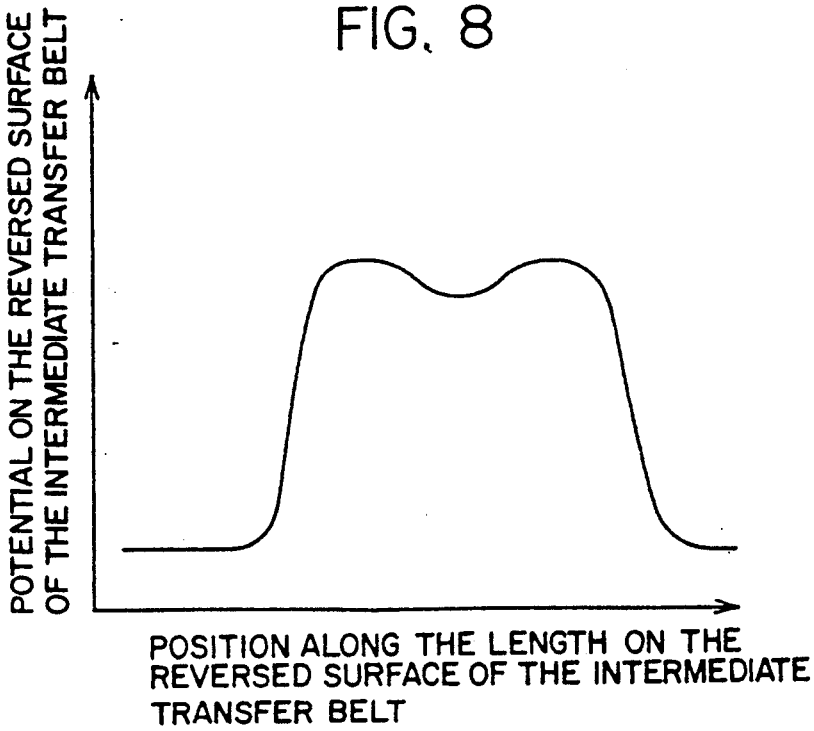
FIG. 8 is a graph showing the potential on the reverse surface of the intermediate transfer belt of this invention.
Figure 9:
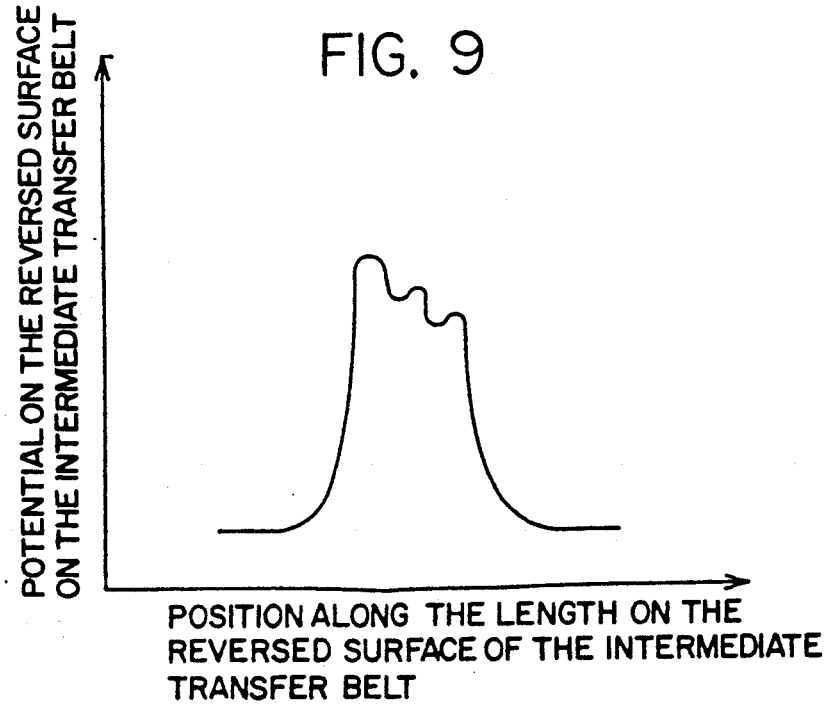
FIG. 9 is a graph showing the potential on the rear surface of the intermediate transfer belt in a conventional device.

The transfer rollers are positioned in such a way as to press the intermediate transfer belt onto the photoconductor, thus increasing the pressing force of the intermediate transfer belt against the photoconductor. In this situation, when a voltage of polarity opposite to that of toner is applied to the two transfer rollers, the toner on the photoconductor is attracted toward the transfer rollers onto the intermediate transfer belt. At this time, the potential on the reverse surface of the intermediate transfer belt will be such as shown in FIG. 8. That is, a high potential is obtained over a relatively wide area on the reverse surface of the intermediate transfer belt between the two transfer rollers, thus enabling toner transfer to be performed over that wide area. Also, because almost uniform potential is obtained on the reverse surface of the intermediate transfer belt between the two transfer rollers, unevenness of transfer can be prevented. Furthermore, since the transfer rollers do not directly contact the intermediate transfer belt during the toner transfer, there is no possibility of the toner converging on the position facing the transfer rollers, thus preventing the image from being disturbed.

The transfer rollers may be made as idlers that are driven by the rotation of the intermediate transfer belt, so that there is no possibility that the intermediate transfer belt is chafed against the transfer rollers, thus preventing the intermediate transfer belt from being scratched. This will also serve to prevent unevenness of toner transfer.

Also, the voltage applied to the transfer rollers may be limited within the specified range, so that the transfer characteristic of the toner can be enhanced. In other words, this serves to eliminate the possibility of transfer failure due to insufficient electric field, and also the possibility of excessively charging the toner, thus preventing the image from being disturbed due to repulsion between toner particles in high potential toner layers on the intermediate transfer belt.

The intermediate transfer belt in the intermediate transfer device of this invention is formed from a dielectric having a resistivity of approximately $10^7$ to $10^{11}\Omega$ cm, since a sufficient electric field can be created during transfer, eliminating the possibility of charging the intermediate transfer belt from being charged during the 1st transfer, the toner can be smoothly separated during the 2nd transfer.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An image forming apparatus having a photoconductor to which toner adheres and a toner transfer device which transfers toner on said photoconductor to an intermediate transfer belt applied on a plurality of rollers, wherein at least part of the surface of said photoconductor moves in an arc while being pressed against said intermediate transfer belt, said toner transfer device comprising:

a pair of transfer rollers disposed along said intermediate transfer belt between two of said rollers in such a manner that said part of the surface of said photoconductor which moves in an arc is positioned between said transfer rollers, at least part of at least part of a first one of said transfer rollers being located closer to said photoconductor than a first tangent touching said photoconductor and one of said two rollers, at least part of a second one of said transfer rollers being located closer to said photoconductor than a second tangent touching said photoconductor and the other roller of said two rollers, thereby allowing a certain length of said intermediate transfer belt between said two transfer rollers to be pressed against said part of the surface of said photoconductor moving in an arc; and a means for applying voltage to said transfer rollers, the voltage polarity being opposite to that toner on said photoconductor.

2. An image forming apparatus according to claim 1, wherein each of said transfer rollers is so located that said intermediate transfer belt is not caught between the transfer roller and said photoconductor.

3. An image forming apparatus according to claim 2, wherein each of said transfer rollers is so located as to position said intermediate transfer belt approximately 0.5 to 1.5 mm outwardly from each of said tangent.

4. An image forming apparatus according to claim 2, wherein each of said transfer rollers is located approximately 10 to 15 mm away from the point at which each of said tangents touches said photoconductor.

5. An image forming apparatus according to claim 1, wherein said two transfer rollers function as idlers that are driven by the rotation of said intermediate transfer belt.

6. An image forming apparatus according to claim 1, wherein the voltage applied to said transfer rollers is within the range of 400 to 1000V of the opposite polarity to that of the toner.

7. An image forming apparatus according to claim 1, wherein said intermediate transfer belt is formed of a dielectric having a resistivity of approximately $10^7$ to $10^{11}\Omega$ cm.

* * * * *